US006349706B1

(12) United States Patent
Hsu et al.

(10) Patent No.: US 6,349,706 B1
(45) Date of Patent: Feb. 26, 2002

(54) HIGH INJECTION RATE, DECREASED INJECTION DURATION DIESEL ENGINE FUEL SYSTEM

(75) Inventors: Bertrand Dahung Hsu, San Jose, CA (US); Gong Chen; Robert Douglas Cryer, both of Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/426,249

(22) Filed: Oct. 25, 1999

Related U.S. Application Data

(60) Provisional application No. 60/108,533, filed on Nov. 16, 1998.

(51) Int. Cl.[7] ..... F02M 37/04
(52) U.S. Cl. ..... 123/500; 123/496
(58) Field of Search ..... 123/496, 500, 123/501, 507, 508, 509

(56) References Cited

U.S. PATENT DOCUMENTS 1,865,099 A * 6/1932 Groff ..... 123/496
3,566,849 A * 3/1971 Frick ..... 123/496
3,965,875 A * 6/1976 Perr ..... 123/496
5,095,873 A * 3/1992 Motoyama et al. ..... 123/305
5,183,013 A * 2/1993 Ito et al. ..... 123/501
5,551,398 A * 9/1996 Gibson et al. ..... 123/446
5,823,168 A * 10/1998 Otoh et al. ..... 123/496

FOREIGN PATENT DOCUMENTS

DE 1950019 * 6/1970 ..... 123/496
GB 318889 * 8/1930 ..... 123/496

* cited by examiner

*Primary Examiner*—Carl S. Miller
(74) *Attorney, Agent, or Firm*—Carl A. Rowold; Jill M. Breedlove

(57) ABSTRACT

A fuel injection system for a diesel engine operating at retarded fuel injection timing includes a fuel cam configured to increase a fuel injection pressure and decrease a fuel injection duration, thereby improving fuel atomization and combustion in a plurality of engine cylinders and improving an indicated efficiency of the engine and reducing exhaust emissions. The fuel cam is oriented in a phase relationship with a compression stroke top-dead-center position to accommodate the retarded fuel injection timing and to optimize an engine brake efficiency and performance.

17 Claims, 3 Drawing Sheets

HIGH INJECTION RATE, DECREASED INJECTION DURATION DIESEL ENGINE FUEL SYSTEM

CROSS-REFERENCE TO RELATED APPLICATION

This application claims the benefit of U.S. provisional application No. 60/108,533, filed Nov. 16, 1998.

BACKGROUND OF THE INVENTION

This invention relates generally to diesel engines and, more particularly, to fuel injection systems for diesel engines.

In a diesel engine, liquid fuel is injected into a plurality of engine cylinders full of compressed air at high temperature. The fuel is broken up into droplets, which evaporate and mix with the air in the cylinders to form a flammable mixture. The fuel efficiency and exhaust emissions of diesel engines are dependent upon the fuel injection timing and atomization. This is particularly true for quiescent type medium speed heavy-duty diesel engines where the cylinder air intake swirling is light, such as locomotive or marine type engines with relatively large displacement volumes.

For various reasons, including reducing exhaust emission of nitrogen oxides (NOX), it is sometimes desirable to retard the fuel injection timing of a medium speed diesel engine, i.e., retard the start of the fuel injection duration relative to conventional fuel injection start timing in an engine piston cycle. However, retarding the fuel injection timing increases untimely and/or incomplete combustion in the engine cylinders. Untimely combustion compromises engine efficiency and incomplete combustion increases exhaust emissions, including carbon monoxide (CO), particulate matters (PM) and smoke. Untimely and incomplete combustion can also have adverse effects on other engine components, such as turbochargers that derive energy from the exhaust gases. Untimely combustion increases the temperature of exhaust gases, which can lead to turbocharger overspeed and damage.

Accordingly, it would be desirable to provide a medium speed diesel engine that avoids performance deterioration at retarded fuel injection timings.

BRIEF SUMMARY OF THE INVENTION

In an exemplary embodiment of the invention, a fuel injection system for a medium speed diesel engine is provided that increases fuel injection pressure and reduces a fuel injection duration to enhance engine efficiency and to reduce exhaust emissions of medium speed diesel engines operated at retarded fuel injection timing. The reduced fuel injection duration advances fuel injection duration ending time to an earlier point in the piston cycle, and the increase in fuel injection pressure improves the atomization of fuel. Consequently, combustion in the engine is improved.

The fuel injection system includes a fuel cam having a cam surface shaped to increase the cam lift velocity of a fuel injection system, thereby increasing fuel injection pressure, reducing fuel injection duration, and improving fuel atomization. A cam roller contacts the surface of the fuel cam and actuates a fuel injection pump plunger to control the fuel injection rate into the engine cylinders. The cam is rotated by a cam shaft about a rotational axis, and the shape of the cam causes the roller cam, and hence the fuel injection pump plunger, to move radially toward and away from the cam shaft.

Specifically, the cam surface includes a plunger return segment and a plunger advance segment. The plunger advance segment has an increasing radius so that when the cam roller contacts the plunger advance segment, the plunger is advanced into the fuel injection pump and forces fuel to be injected from a pump chamber into the engine cylinders. The plunger return segment has a decreasing radius so that the plunger is withdrawn from the fuel injection pump and draws fuel into the pump chamber. The plunger advance and return segments are oriented in a phase relationship with the compression stroke top-dead-center position so that plunger advance segment accommodates the retarded fuel injection timing and engine brake efficiency and performance are optimized.

The plunger advance segment increases rapidly in radius as the cam is rotated, and the plunger return segment decreases in radius relatively slowly. The rapid rise in the plunger advance segment radius increases the cam lift velocity relative to conventional cams. Increasing the cam lift velocity increases the fuel injection pressure, which improves atomization of fuel in the cylinders. The increased cam lift velocity also increases the rate of fuel injection, which reduces fuel injection duration and realizes an earlier, or advanced, fuel injection ending time. Consequently, the combustion of fuel in the cylinders is improved and untimely combustion in the engine cylinders is reduced. Thus the performance deterioration in engine efficiency and exhaust emissions due to retarded fuel injection timing are minimized.

DETAILED DESCRIPTION OF THE INVENTION

Figure 1:
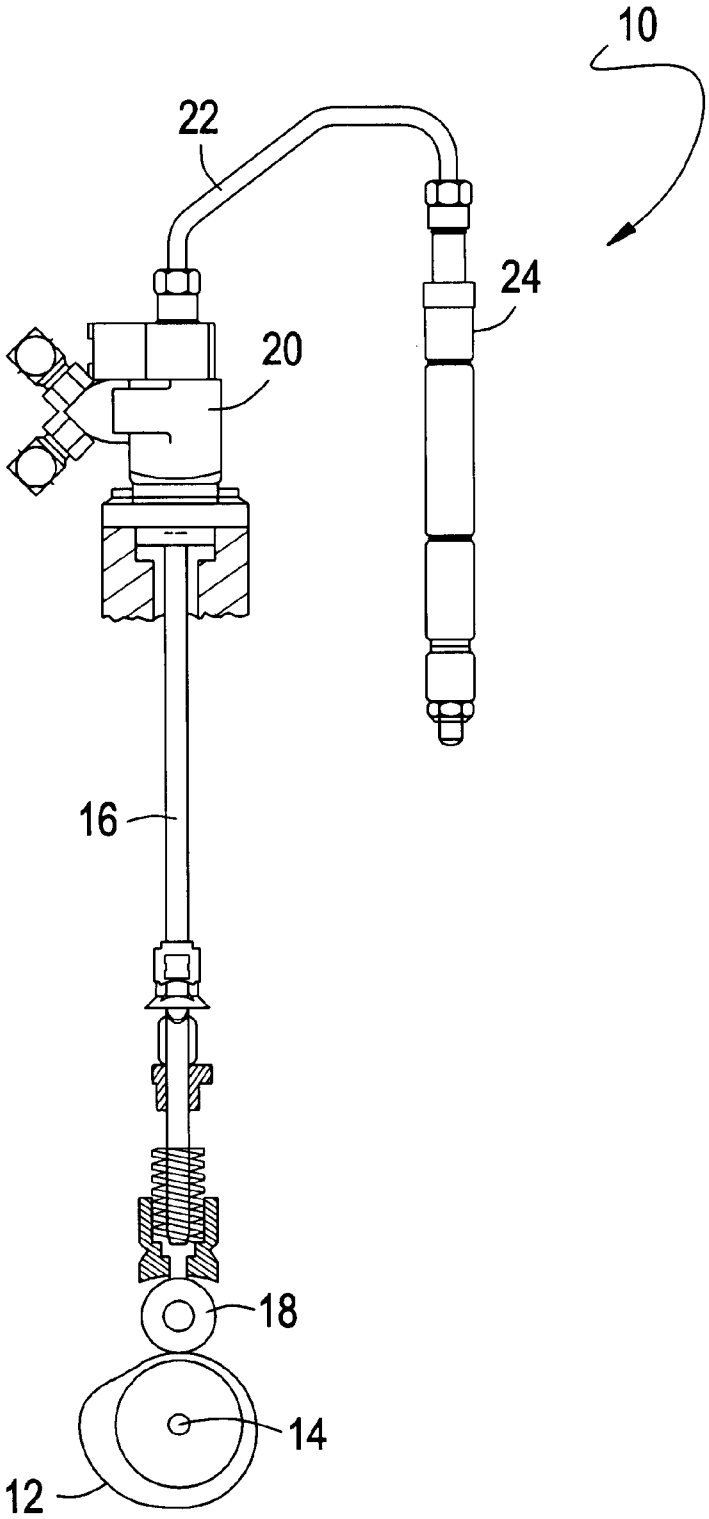
FIG. 1 is a partial plan view of a fuel injection system including a fuel cam.

FIG. 1 illustrates a fuel injection system 10 including a cam 12, a cam roller 14, a push rod 16, a fuel injection pump 18, and a fuel injector 20. Fuel injection system 10 increases fuel injection pressure and reduces a fuel injection duration to enhance engine efficiency and to reduce exhaust emissions of medium speed diesel engines, such as locomotive engines, operated at retarded fuel injection starting timing to reduce NOX emissions. It is recognized, however that the benefits of the invention may accrue to other applications of diesel engines. Therefore, this embodiment of the invention is intended solely for illustrative purposes and is in no way intended to limit the scope of application of the invention.

In a particular embodiment, the shape of cam 12 increases a cam lift velocity, which increases fuel injection pressure and fuel injection rate to shorten the fuel injection duration. Consequently, the fuel injection duration ending time is advanced and atomization of fuel improved, which reduce untimely combustion in a plurality of engine cylinders (not shown).

Cam roller 14, push rod 16, fuel injection pump 18, and fuel injector 20 are conventional, and their basic structure and operation well known. Briefly, cam 12 rotates about a rotational axis 22 of a cam shaft (not shown) to which cam 12 is connected. Cam roller 14 contacts cam 12 and actuates push rod 16 for reciprocal motion toward and away from rotational axis 22 as cam roller 14 contacts rotating cam 12. A fuel injection pump plunger (not shown) is connected to push rod 16 for reciprocating motion within fuel injection pump 18. During a plunger advance stroke into fuel injection pump 18, the plunger expels fuel from a pump chamber inside fuel injection pump 18, through a fuel line 24 and to fuel injector 20 via a fuel input port. Typically, a valve in fuel injection pump 18 controls the flow of fuel through an injector nozzle into an engine cylinder. During a plunger return stroke, the plunger is withdrawn from the fuel injection pump chamber and draws fuel into fuel injection pump 18 from a fuel tank (not shown).

Figure 2:
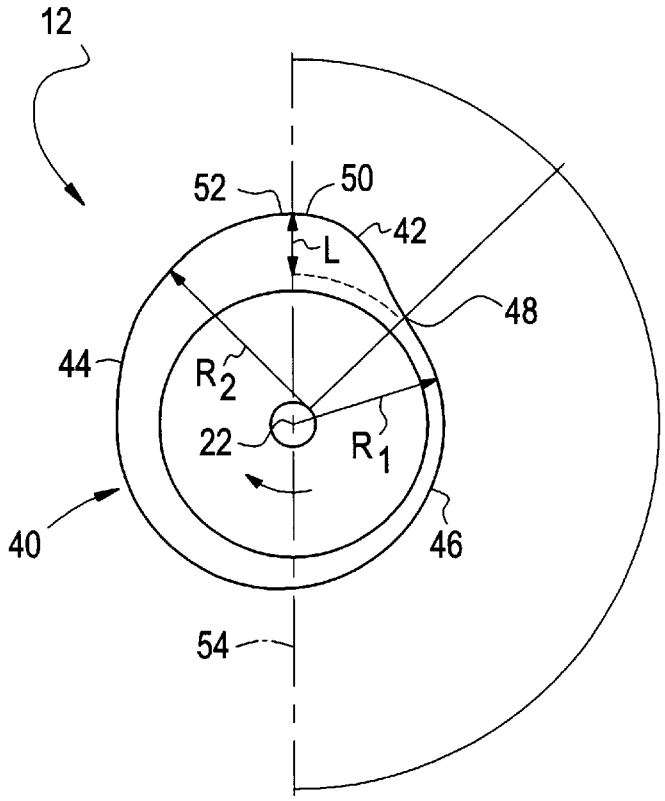
FIG. 2 is a top plan of the fuel cam shown in FIG. 1.

FIG. 2 is a plan view of fuel cam 12 that increases the cam lift velocity to increase the fuel injection rate and enhance atomization of fuel in the engine cylinders. Fuel cam 12 includes a cam surface 40 having three distinct segments: a plunger advance segment 42, a plunger return segment 44, and a plunger dwell segment 46. Plunger advance segment 42 has a first end 48, a second end 50, and a generally increasing radius from rotational axis 22 from first end 48 to second end 50. Plunger return segment 44 extends from a first end 52 coincident with plunger advance segment second end 50 to a second end 54, and has a generally decreasing radius from rotational axis 22 from first end 52 to second end 54. Plunger dwell segment 46 extends from plunger return segment second end 54 to plunger advance segment first end 48 and has a constant radius $R_1$.

In a particular embodiment, plunger return segment extends a constant radius $R_2$ that is larger than radius $R_1$ and radially offset from radius $R_1$ by a distance approximately equal to one half the linear length of the cam lift L between plunger advance segment first end 48 and second end 50.

Plunger return segment 44 is longer in arcuate length than plunger dwell segment 46 and plunger advance segment 42, and plunger dwell segment 46 is longer in arcuate length than plunger advance segment 42. More specifically, and in terms of rotational degrees from rotational axis, plunger return segment 44 is about 4 times larger than plunger advance segment 42, and plunger dwell segment 46 is about 3 times larger than plunger advance segment 42. Even more specifically, plunger return segment 44 occupies about 180° of rotation of fuel cam about rotational axis, plunger dwell segment 46 occupies about 133° of rotation, and plunger advance segment 42 occupies about 47° of rotation. Thus, plunger advance segment 42 rotationally occupies only about ⅛ of the cam surface 40.

Thus, from a 0° position at plunger advance segment first end 48, cam surface 40 rises, i.e., increases in radius, along plunger advance segment 42, falls, i.e., decreases in radius, along the plunger return segment 44, and remains constant in plunger dwell segment 46 as fuel cam 12 is rotated clockwise about rotational axis 22 in FIG. 2. Because plunger return segment 44 decreases in radius by the same amount that plunger advance segment 42 increases in radius, but over a rotational duration approximately 4 times as large, plunger advance segment 42 rises rapidly, i.e., in a shorter period of time, relative to the falling plunger return segment 44.

When installed in fuel injection system 10 (FIG. 1), fuel cam 12 rotates from the 0° position and cam roller 14 follows cam surface 40 along plunger advance segment 42. Because cam surface 40 in plunger advance segment 42 is rising, cam follower 14 moves away from cam rotational axis 22, which, in turn, moves push rod 16 and the fuel injection pump plunger into fuel injection pump 18, which compresses and expels fuel from fuel injection pump 18 into fuel injector 20 via fuel line 24. Further, because plunger advance segment 42 rises rapidly, the plunger moves at higher velocity, which increases the pressure of the fuel expelled from fuel injection pump 18. For a given quantity of fuel, higher pressure fuel is therefore injected into the engine cylinders for a shorter period of time. The increased fuel injection pressure over a shorter duration leads to an earlier or advanced fuel injection duration ending time and improves the atomization of fuel, thereby reducing untimely and incomplete combustion in the engine cylinders.

While the increased fuel injection pressure improves an engine indicated efficiency and promotes fuel-air mixing and timely combustion in the engine to improve engine indicated efficiency and reduce smoke emissions, it is recognized that increased fuel injection pressure can affect engine performance in other aspects. For example, an engine-driven fuel injection system consumes more power from the engine when injecting higher pressure fuel, which can affect a brake efficiency of the engine. If the improvement in engine indicated efficiency is insufficient to balance the additional power required to drive the higher injection fuel system, a engine brake efficiency will suffer.

Figure 3:
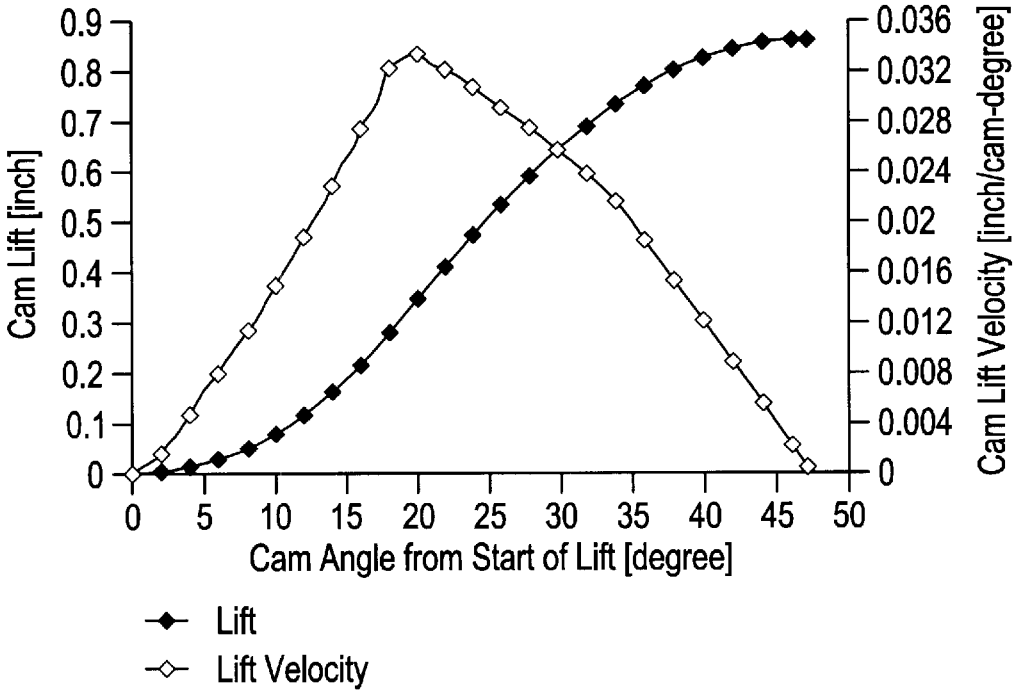
FIG. 3 is a cam lift and cam velocity profile of the fuel cam shown in FIG. 2.

FIG. 3 illustrates the cam lift and velocity profile of fuel cam 12 from the beginning of the cam lift, i.e., from first end 48 of plunger advance segment 42. The cam lift, i.e., increase in radius, is modest from about 0° to 10°, steep from about 10° to 40°, and substantially levels off at about 45° of rotation about rotational axis 22 from plunger advance segment first end 48.

Plunger advance segment 42 and return segment 44 are oriented in a phase relationship with the compression stroke top-dead-center position so that plunger advance segment accommodates the retarded fuel injection timing. For example, first end 48 of plunger advance segment 42, is positioned about 40° to about 50° crank angle before the compression stroke top-dead-center for optimum enhancement of fuel atomization in the cylinders. In a particular embodiment, first end 48 of plunger advance segment 42 is positioned about 49° crank angle before the compression stroke top-dead-center. The above-described phase relationship sufficiently increases the engine indicated efficiency to overcome the additional power needed to drive the higher pressure fuel injection system and to achieve an optimum engine brake efficiency.

Figure 4:
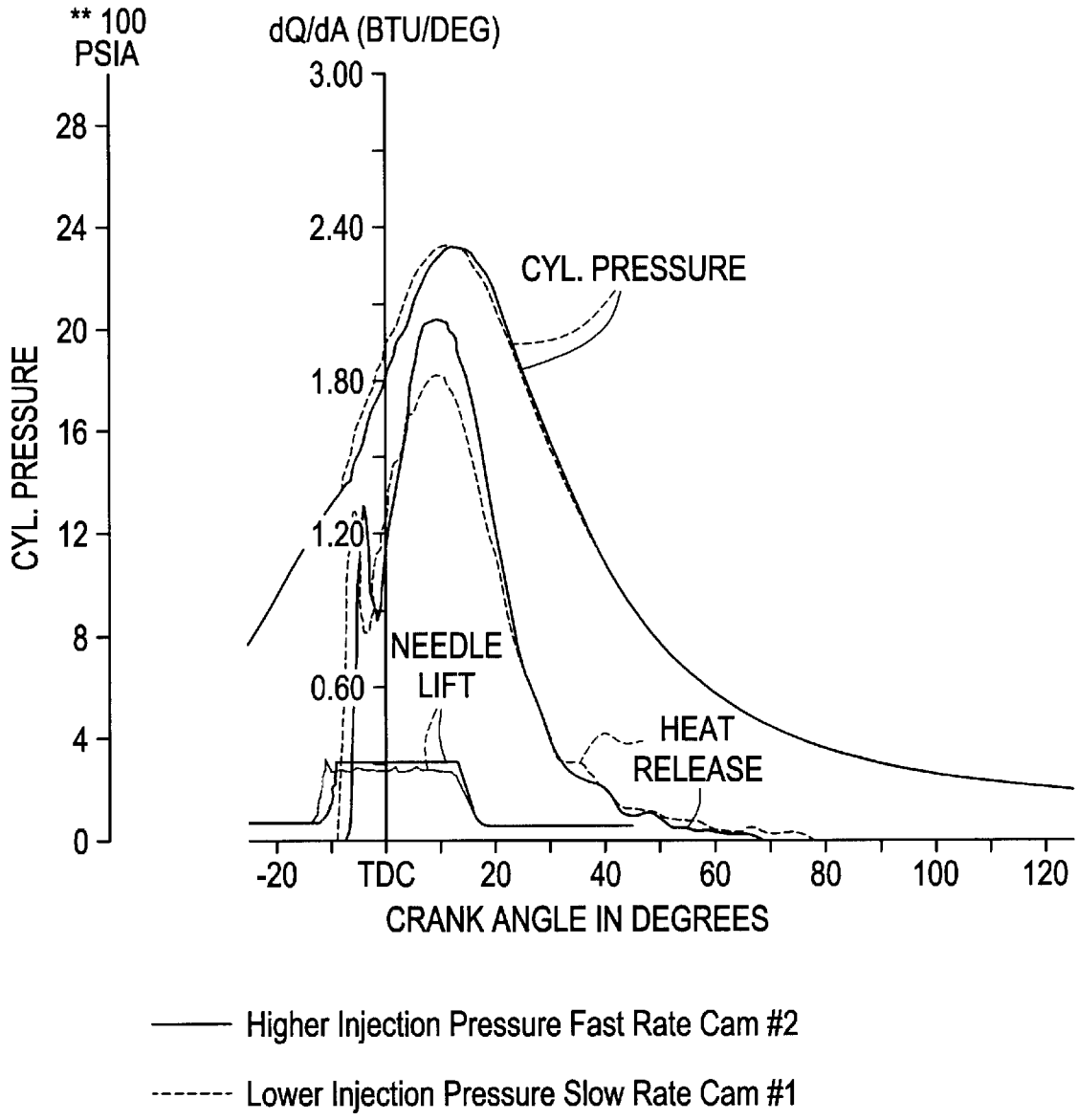
FIG. 4 is a graph comparing engine cylinder pressure and fuel injection pressure of the cam of FIGS. 1 and 2 with a conventional cam.

FIG. 4 graphically compares the performance of high injection rate fuel cam 12 operated at retarded fuel injection timing with a conventional lower injection pressure, slower rate fuel cam operated at conventional fuel injection timing. Fuel injection system characteristics with fuel cam 12 are plotted in solid lines, and fuel injection system characteristics with a conventional cam are plotted in dashed lines. As seen in FIG. 4, the injector needle lift with cam 12 is shorter in comparison to the conventional cam, while the engine cylinder pressure is about the same because the fuel injection start timing used with cam 12 is retarded in comparison to the conventional cam system. Thus, despite an increased fuel injection pressure and shortened fuel injection duration produced by fuel cam 12, the ensuing cylinder pressure is commensurate with conventional systems, thereby rendering structural modifications to the engine power cylinders because of increased pressure in the cylinders unnecessary. Thus, fuel injection system 10 may be used with existing equipment without extensive rebuilding of engines.

Also, due to the increased fuel injection pressure produced by fuel cam 12, fuel/air mixing is improved and the maximum heat release rate of cam 12 is much higher in comparison to the conventional cam. Further, the heat release produced with fuel cam 12 is concentrated over a smaller crank angle duration, thereby improving the timeliness of combustion. Consequently, CO, PM and smoke emissions are reduced and the engine efficiency improved when cam 12 is used, despite retarded fuel injection timing.

Thus, using fuel cam 12 which increases cam lift velocity and produces higher fuel injection pressure over a shorter fuel injection duration, fuel injection start timing may be retarded to reduce NOX emission without incurring increased emissions of CO, PM and smoke common in conventional systems operated at retarded fuel injection timing. A cleaner, more efficient fuel injection system is therefore provided, and the performance and efficiency of the engine is improved.

While the invention has been described in terms of various specific embodiments, those skilled in the art will recognize that the invention can be practiced with modification within the spirit and scope of the claims.

What is claimed is:

1. A method for reducing exhaust emissions and improving efficiency of a diesel engine having a fuel injection system comprising a fuel injector, a fuel injection pump, a push rod movable relative to the pump and a cam for reciprocating the push rod relative to the pump to pressurize the fuel for injection via the fuel injector, said method comprising:

decreasing the duration of the time period for fuel injection by:

retarding the fuel injection start time relative to that of conventional engines to reduce emission of nitrogen oxide; and advancing the fuel injection ending time relative to that of conventional engines; and increasing the cam lift velocity relative to that of conventional engines to increase the fuel injection pressure and the rate at which the fuel injection pressure increases for improved fuel atomization to improve engine efficiency and to reduce emission of carbon monoxide, particulate matters and smoke.

2. A method in accordance with claim 1 wherein the fuel cam includes a plunger advance segment and a plunger return segment, said method further comprising orienting the fuel cam in a phase relationship with a compression stroke top-dead-center position to accommodate the retarded fuel injection timing.

3. A method in accordance with claim 2 wherein the step of orienting the fuel cam in a phase relationship with a compression stroke top-dead-center position to accommodate the retarded fuel injection timing further comprises optimizing a brake efficiency value of the engine.

4. A method in accordance with claim 2 wherein orienting the fuel cam in a phase relationship with a compression stroke top-dead-center comprises positioning a leading end of the plunger advance segment about 40 degrees crank angle to about 50 degrees crank angle before the compression stroke top-dead-center.

5. A method in accordance with claim 4 wherein said orienting the fuel cam in a phase relationship with a compression stroke top-dead-center further comprises positioning of the leading end of the plunger advance segment about 49 degrees crank angle before the compression stroke top-dead-center.

6. A method in accordance with claim 1 wherein said fuel injection system includes a fuel cam and an injector needle, said decreasing a fuel injection duration comprises shortening of the duration of a needle lift of the fuel cam.

7. A method for reducing exhaust emissions and improving efficiency of a diesel engine including a fuel injection system, said method comprising:

retarding fuel injection timing to reduce emission of nitrogen oxides; and decreasing a fuel injection duration and improving fuel atomization to improve engine efficiency and reduce emission of carbon monoxide, particulate matters and smoke, with the decreasing of the fuel injection duration comprising advancing a fuel injection duration ending time.

8. A method in accordance with claim 1 wherein the engine includes at least one engine cylinder, said step of decreasing a fuel injection duration comprising the step of concentrating a heat release in the engine cylinder over a smaller crank angle duration.

9. A diesel engine fuel injection system for injecting fuel into at least one engine cylinder at retarded fuel injection timing, said fuel injection system comprising:

a cam comprising a cam surface and a rotational axis;

a cam roller contacting said cam surface;

a push rod connected to said cam roller for reciprocal movement toward and away from said rotational axis as said cam rotates about said rotational axis;

a fuel injection pump for pumping fuel into the at least one engine cylinder in response to movement of said push rod;

the cam surface presenting an advance segment configured to increase a cam lift velocity and increase fuel injection pressure relative to conventional engines for improved fuel atomization to improve engine efficiency and to reduce emissions of carbon monoxides, particulate matters and smoke; and the cam surface advance segment being configured to decrease the duration of the time period for fuel injection by retarding the fuel injection start time relative to that of conventional engines to reduce emission of nitrogen oxide and by advancing the fuel injection end time relative to that of conventional engines.

10. A diesel engine fuel injection system in accordance with claim 9, wherein said cam surface comprises a plunger dwell segment of constant radius, a plunger advance segment of increasing radius relative to said plunger dwell segment, and a plunger return segment of decreasing radius relative to said plunger advance segment.

11. A diesel engine fuel injection system in accordance with claim 10 wherein said plunger return segment extends over a larger degrees of rotation than said plunger dwell segment.

12. A diesel engine fuel injection system in accordance with claim 10 wherein said plunger advance segment extends over a smaller crank angle duration than said plunger dwell segment.

13. A diesel engine fuel injection system in accordance with claim 10 wherein said plunger advance segment comprises a first end at a first radius from said rotational axis and a second end at a second radius from said rotational axis, said second radius larger than said first radius, said first radius equal to the plunger dwell segment radius.

14. A diesel engine fuel injection system in accordance with claim 13 wherein said second radius is offset from said first radius.

15. A diesel engine fuel injection system in accordance with claim 10 wherein said plunger return segment extends between said second end of said plunger advance segment and said plunger dwell segment, said plunger return segment decreasing in radius from said rotational axis between plunger advance segment second end and plunger dwell segment.

16. A diesel engine fuel injection system in accordance with claim 10 wherein said cam surface equals or exceeds said dwell segment radius throughout a complete revolution of said cam.

17. A diesel engine fuel injection system in accordance with claim 10, the at least one engine cylinder including a compression stroke top-dead-center position, a leading end of said plunger advance segemnt being positioned about 40 degrees to about 50 degrees crank angle before the compressiom stroke top-dead-center.

* * * * *